US006676124B1

(12) United States Patent
Wirtz

(10) Patent No.: US 6,676,124 B1
(45) Date of Patent: Jan. 13, 2004

(54) DEVICE FOR ALIGNING SHEETS

(75) Inventor: Andreas Wirtz, Neubiberg (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/830,136

(22) PCT Filed: Oct. 22, 1999

(86) PCT No.: PCT/EP99/08017

§ 371 (c)(1),
(2), (4) Date: Apr. 23, 2001

(87) PCT Pub. No.: WO00/24659

PCT Pub. Date: May 4, 2000

(30) Foreign Application Priority Data

Oct. 23, 1998 (DE) ..... 198 48 972

(51) Int. Cl.[7] ..... B65H 9/00

(52) U.S. Cl. ..... 271/236; 271/234; 271/245; 271/250

(58) Field of Search ..... 271/234, 236, 271/239, 245, 250, 251, 241, 220

(56) References Cited

U.S. PATENT DOCUMENTS

| | | | | |
|---|---|---|---|---|
| 3,669,447 A | | 6/1972 | Turner et al. | |
| 4,017,066 A | | 4/1977 | Lasher et al. | |
| 4,359,219 A | | 11/1982 | Garavuso | |
| 4,531,929 A | * | 7/1985 | Schwardt | 493/55 |
| 4,589,654 A | | 5/1986 | Kanoto | |
| 4,687,193 A | | 8/1987 | Scarabino et al. | |
| 4,946,153 A | | 8/1990 | Kinoshita et al. | |
| 5,161,844 A | * | 11/1992 | Zimmer et al. | 294/61 |
| 5,338,022 A | * | 8/1994 | Funk et al. | 271/184 |
| 5,415,390 A | | 5/1995 | Guerrero | |
| 5,601,283 A | | 2/1997 | Pinckney | |

FOREIGN PATENT DOCUMENTS

| | | | | |
|---|---|---|---|---|
| EP | 0 045 657 | | 2/1982 | |
| EP | 0 407 152 A2 | | 1/1991 | |
| WO | WO 89/08599 | * | 9/1989 | B65H/33/08 |

* cited by examiner

*Primary Examiner*—Donald P. Walsh
*Assistant Examiner*—Jeffrey A. Shapiro
(74) *Attorney, Agent, or Firm*—Schiff Hardin & Waite

(57) ABSTRACT

A printer or copier has a sheet alignment apparatus including a pair of detents, or walls, at a right angle to one another against which the sheet is moved. To move the sheet, a sheet positioning mechanism is provided which includes two paddlewheels that engage the sheet as they rotate and that are directed offset from one another. The paddlewheels may be angled to shear with one another, and the mounting on which they are supported may be pivotable to redirect the paddlewheels.

31 Claims, 12 Drawing Sheets

DEVICE FOR ALIGNING SHEETS

BACKGROUND OF THE INVENTION

1. Field of the Invention

The present invention is directed to a device for aligning sheets, having a sheet acceptance region that is limited by two detents arranged at a right angle relative to one another, and having a sheet positioning mechanism that is arranged within the sheet acceptance region lying opposite the corner limited by the two detents, whereby the sheet positioning mechanism comprises at least one paddlewheel that can be rotationally driven around a drive axis that is approximately parallel to the plane of the sheet acceptance region, so that a sheet supplied to the sheet acceptance region is brought into a seated condition with both detents.

2. Description of the Related Art

European Patent Document EP 0 045 657 A1 discloses a copier device having a mechanism for aligning sheets on a masters' plate, whereby the sheets are aligned at two detent edges arranged at a right angle. This mechanism comprises two paddlewheels that are arranged in the corner region of the detent walls. The European reference EP 0 045 657 A1 teaches that each paddlewheel is arranged with an angle of 10° to 25° relative to the neighboring detent edge. As a result thereof, the sheets—in the region of the paddlewheels—are moved at high speed by the respective paddlewheels along the neighboring detent edge to the other detent edge.

The axes of the paddlewheels are connected via a flexible shaft that is driven by a motor. Since both paddlewheels are driven by the common flexible shaft, they are synchronized with one another. The paddles of the two paddlewheels are arranged in anti-phase to one another, so that respectively only one paddlewheel has one of its paddles in contact with a sheet. Having two forces directed in different directions act simultaneously on one sheet is thereby avoided.

Sheets are supposed to be aligned faster at the copier device with this known alignment mechanism than would be manually possible.

The above-cited European Patent Document EP 0 045 657 A1 already discloses an alignment device wherein the paddlewheels are arranged with different conveying directions respectively directed to a detent, whereby this document teaches that the conveying direction of each and every paddlewheel should be arranged with an angle of inclination of 10° through 25° relative to the neighboring detent edge. This means that one of the two paddlewheels has its conveying direction arranged at an angle of 65° through 80° with respect to the sheet delivery direction. Given high delivery speeds, a supplied sheet is therefore placed into a uncontrolled rotational motion that makes a clean alignment of the sheet at the detents impossible.

U.S. Pat. No. 4,589,654 discloses a deposit compartment for the acceptance and stacking of sheets. This deposit compartment is provided with a mechanism for aligning sheets at two detent walls arranged at a right angle using two paddlewheels. One of the two paddlewheels is arranged in the corner region of the detent walls and is aligned obliquely relative to the two detent walls in order to convey the paper sheets against both detent walls. The other paddle wheel is arranged at the detent wall that is arranged at that side lying opposite the principal conveying direction. This paddlewheel is intended to charge the sheets essentially in the principal conveying direction and with a lower force than the first paddlewheel.

Deposit compartments having such a mechanism for aligning sheets can stack sheets with a rate of up to approximately 8 sheets/minute. This stacking rate can be fundamentally influenced by the following parameters:

Sheet delivery speed with which the sheets are supplied to the deposit compartment; the sheet delivery speed especially influences the flight behavior of the sheets after leaving the last conveyor drums. The sheet delivery speed is usually not varied in a specific device; the sheet delivery speeds of different machines, however, can differ.

Spacing with which the sheets are supplied to the deposit compartment, whereby the sheet rate given a constant sheet delivery speed is all the higher the shorter the spacing between two successive sheets is.

Paper type; the paper type is particularly defined by the format, by the basis weight and the surface.

It has been shown that not all paper types can be as neatly stacked given high stacking rates, as a result whereof the stacking quality can be significantly deteriorated. The main reason for this is comprised in the short time available for stacking.

When the stacking rate is to be increased even further beyond the values of 80 sheets/min, then the known mechanisms for aligning sheets are not in the position of neatly stacking different paper types given the desired stacking rate.

U.S. Pat. No. 5,601,283 discloses a device wherein a angle of a sheet positioning mechanism can be modified relative to a conveying direction, being modified with an adjustment mechanism of the sheets to be positioned.

SUMMARY OF THE INVENTION

The present invention is based on an object of providing a device for aligning sheets that can align sheets of different paper types supplied with a high rate (for example, ≧80 sheets/minute) uniformly at two detents, or abutments, arranged at a right angle.

This and other objects are achieved by a device having a device for aligning sheets having a sheet acceptance region that is limited by two detents, or abutments, arranged at a right angle relative to one another, and a sheet positioning mechanism that is arranged within the sheet acceptance region lying opposite the corner limited by the two detents, whereby the sheet positioning mechanism comprises at least one paddlewheel that can be rotationally driven around a drive axis that is approximately parallel to the plane of the sheet acceptance region, so that a sheet supplied to the sheet acceptance region is brought into a seated condition with both detents, whereby the paddlewheel is a double paddlewheel having two individual paddlewheels arranged side-by-side on the drive shaft, and whereby the individual paddlewheels respectively comprise a base member with paddles applied thereto, and the two individual paddlewheels are seated on the drive shaft with play, so that the paddlewheels can turn by an angle relative to one another on the drive shaft.

In a preferred development, the angle lies in the range from ±2° through ±10° and/or in that the two individual paddlewheels are respectively provided with a hole at their base members that is penetrated by a dog pin with play in rotational direction. The sheet positioning mechanism may be adjustable around an axis residing perpendicular to the plane of the acceptance region, so that the conveying direction of the paddlewheel is variable. The axis for the adjustment of the sheet positioning mechanism is a rotational axis proceeding through the center of the paddlewheel, and the drive shaft is seated at an end region of a vertical leg of an L-shaped suspension, whereby the other horizontal leg is arranged above the paddlewheel parallel to the drive shaft. The horizontal leg of the L-shaped suspension is seated at the end region of a paddle lever, being seated rotatable around the rotational axis, whereby the paddle lever has its other end region secured to a mount. Specifically, a driven gear rotatably seated around the rotational axis is provided at the horizontal leg, the rotatory motion thereof being transmitted onto the paddlewheel with a mitre gearing. The driven gear arranged at the suspension is driven by a belt wrapping therearound and around a drive wheel arranged at the mount.

Preferrably, an adjustment mechanism is provided for the adjustment of the conveying direction of the paddlewheel, whereby the adjustment mechanism comprises an adjustment lever that is secured in articulated fashion to an end region of the horizontal leg of the suspension and that is secured to the mount with an adjustment device. The adjustment device is a rotatory lever driven by a stepping motor.

In one embodiment, the axis for the adjustment of the sheet positioning device is a swivelling axis offset from the center of the paddlewheel in the direction to the admission side of the sheet acceptance region, whereby the sheet positioning device can be freely swivelled around the swivelling axis. A damping mechanism may be provided for damping the swivel motion of the paddlewheel. The sheet positioning device is arranged at an end region of a paddle lever and the other end region of the paddle lever is secured to a mount, whereby a drag link is provided at that end region of the paddle lever arranged at the mount, so that at least one part of the paddle lever is fashioned pivotable around the swivelling axis.

The invention also provides a device for aligning paper sheets or the like having a sheet acceptance region that is limited by two detents arranged at a right angle relative to one another, and a sheet positioning mechanism that is arranged within the sheet acceptance region lying opposite the corner limited by the two detents, whereby the sheet positioning mechanism comprises two paddlewheels that can be respectively rotatably driven around a drive axis that is essentially parallel to the plane of the sheet acceptance region and that are arranged with different conveying directions respectively pointing to a detent, so that a sheet supplied to the sheet acceptance region is brought into a seated condition with both detents, the paddlewheels being arranged such that their conveying directions describe an angle with the two detents that lies in the range from 30° through 60°.

The two paddlewheels are arranged on a common, articulated or flexible drive shaft so that they are driven synchronized. The articulated shaft may be a universal joint or an accordion bellows coupling. The paddlewheels can be respectively fashioned of a cylindrical base member having a plurality of radially salient paddles that are arranged at the circumference of the base member with identical spacing from one another, whereby the paddles of the two paddlewheels are arranged offset. The paddlewheels respectively comprise three paddles and the paddles of the two paddlewheels are respectively arranged offset by 60° relative to one another. Two paddlewheels can be arranged in such close proximity to one another that the paddles of the two paddlewheels shear into one another. A driven gear is preferably is arranged between the two paddlewheels, the driven gear including a drive shaft stub projecting at both lateral surfaces that are respectively connected in articulated and torsional fashion to a bearing sleeve for the acceptance of respectively one of the paddlewheels. The paddlewheels may be arranged at an end region of a paddle lever, whereby the other end region of the paddle lever is secured to a mount.

The two paddlewheels are preferably adjustable independently of one another around a rotational axis perpendicular to the plane of the acceptance region. Alternatively, the two paddlewheels are respectively provided with a separate suspension that is respectively rotatably hinged to a paddle lever, and a respective adjustment mechanism is provided for the adjustment of the conveying direction of the paddlewheels, whereby the adjustment mechanisms respectively includes an adjustment lever extending approximately parallel to the paddle lever, said adjustment levers being respectively secured articulated to the suspension and, using an adjustment device exerting a rotational motion onto the respective suspension and the corresponding paddlewheel. The conveying directions of the two paddlewheels of one embodiment describe a constant angle and the two paddlewheels are seated at an end region of a paddle lever, whereby the axis for the adjustment of the sheet positioning device is a swivelling axis offset from the common drive shaft in the direction toward the admission side of the sheet acceptance region, whereby the sheet acceptance device is freely pivotable around the swivelling axis. Specifically, the angle between the conveying directions of the two paddlewheels lies in the range from 10° through 20°. A flexible or articulated telescoping rod that compensates the rotational or, respectively, swivel motions is provided for driving the two paddlewheels. The telescoping rod can extend approximately parallel to the paddle lever from a mount to which a paddle lever that holds the paddlewheels is attached up to a mitre gearing connected to the drive shaft of the two paddlewheels.

In a further development, the device for aligning sheets has a sheet acceptance region that is limited by two detents arranged at a right angle relative to one another, and a sheet positioning mechanism that is arranged within the sheet acceptance region lying opposite the corner limited by the two detents, whereby the sheet positioning mechanism comprises at least one paddlewheel that can be rotationally driven around a drive axis that is approximately parallel to the plane of the sheet acceptance region, so that a sheet supplied to the sheet acceptance region is brought into a seated condition with both detents, whereby the sheet positioning device is adjustable around an axis residing perpendicular to the plane of the acceptance region, so that the conveying direction of the paddlewheel is variable.

The invention is based on the perception that the sheets usually do not simultaneously reach the two detents given the known devices for aligning sheets at two detents arranged at a right angle to the transport path. The sheets are quickly driven against one of the two detents and are then moved noticeably more slowly along this detent toward the other detent.

Investigations in the part of the inventor have shown that the detent that the sheets reach first is dependent on the sheet delivery speed and on the sheet type. Due to their high kinetic energy, papers having a high basis weight reach the front detent lying in a sheet delivery direction first, and sheets having a low basis weight reach the detent arranged at the side with respect to the sheet delivery direction first. Short recording media formats with respect to the sheet running direction reach the lateral detent first, in contrast whereto longer formats reach the front detent first. The effects due to the basis weight and the format superimpose on one another.

In a first aspect of the invention, these problems are eliminated in that the paddlewheel is a double paddlewheel having two individual paddlewheels arranged side-by-side on the drive shaft, whereby the individual paddlewheels respectively comprise a base member with paddles applied thereto, and the two individual paddlewheels are seated on the drive shaft with play, so that the paddlewheels can turn by an angle relative to one another on the drive shaft.

In a second aspect of the invention, which can also solve the aforementioned problem independently of the first aspect, it is provided that a sheet positioning mechanism is adjustable around an axis residing perpendicularly to the plane of the acceptance region, so that the conveying direction of the paddlewheel is variable.

According to this second aspect, the conveying direction of the paddlewheel can be set dependent on the paper type such that the sheets reach the two detents essentially simultaneously. Fundamentally, an adaptation to the modification of the sheet delivery speed is also possible. As a result thereof, the slow conveying speed along one of the two detents is avoided, and a considerable time-saving is achieved in the alignment of the sheets.

According to a third aspect of the invention, which can likewise achieve the object independently of the two aspects cited first, two paddlewheels directed in different directions respectively pointing to a detent are provided, whereby their conveying directions describe an angle with the two detents that lies in the range is from 30° through 60° and, preferably, in the range from 35° through 55°.

It has been shown that the supplied sheets are quickly delivered to the one detent by one of the two paddlewheels and are quickly delivered to the other detent by the other paddlewheel. When the conveying directions are not variable, it can in fact not be assured that the two detents are reached simultaneously, as in the first solution set forth above; however, the gradual conveying event along one of the two detents given the known alignment devices is considerably shortened since the sheets are simultaneously conveyed to the two detents in the invention, as a result whereof a clear saving of time is achieved in the alignment of the sheets.

A preferred embodiment of the invention, particularly of the aforementioned second aspect, has the shaft for the adjustment of the sheet positioning mechanism as a swivelling shaft offset from the center of the paddlewheel in the direction toward the admission side of the sheet acceptance region, whereby the sheet positioning mechanism can be freely swivelled around the shaft.

Given this alignment device, the optimum angle of the conveying direction of the paddlewheel is automatically set, since an increased resistance directed opposite the detent opposes the paddlewheel when this detent is reached, the paddlewheel evading this resistance in the direction to the other detent. When the sheet simultaneously reaches both detents, a force equilibrium occurs at the paddlewheel, so that the paddlewheel is no longer swivelled around the swivelling shaft, whereby the conveying direction is set such that the sheet to be aligned simultaneously reaches both detents. Employing the simplest technical outlay, an arrangement that automatically adjusts to the optimum angle is created, so that the incoming sheets simultaneously reach the two detents.

This embodiment with self-adjusting conveying direction of the paddlewheel can also be fashioned with a double paddlewheel.

BRIEF DESCRIPTION OF THE DRAWINGS

The various aspects of the invention are explained by way of example in greater detail below on the basis of exemplary embodiments shown in the attached drawings.

FIGS. 7*a*, 7*b* and 7*c* show the device of FIG. 6 while being swivelled in.

DETAILED DESCRIPTION OF THE PREFERRED EMBODIMENTS

Figure 1:
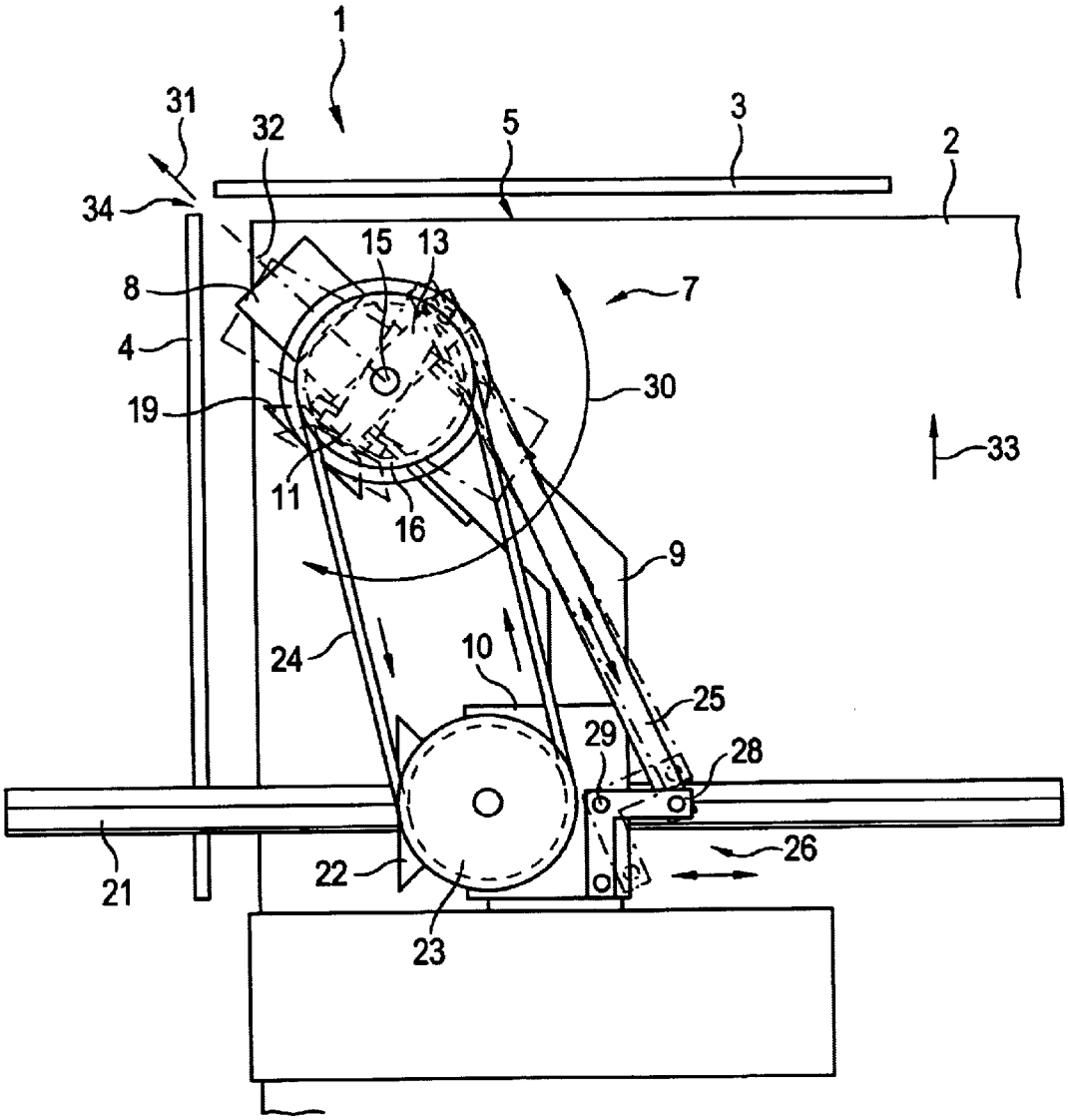
FIG. 1 shows a device for aligning sheets with a paddlewheel rotatable around a vertical axis, in plan view.

FIG. 1 shows a first exemplary embodiment of the inventive device 1 for aligning sheets 2 or the like. The sheets 2 are rectangular and can be sheets of papers, foils or the like.

The alignment device 1 comprises a sheet acceptance region 5 limited by two detents 3 and 4. The detents 3 and 4 have a longitudinal extent and are arranged at a right angle relative to one another. For example, they form detent walls of a deposit compartment of a printer or are fashioned as stop edges at a glass surface of a copier device.

A sheet positioning mechanism 7 that comprises a paddlewheel 8, a paddle lever 9 and a mount 10 is provided for aligning the sheets 2. The paddlewheel 8 is arranged at one end region of the paddle lever 9, and the mount 10 is arranged at the other end region of the paddle lever 9.

The paddlewheel 8 (see FIGS. 2*a* and 2*b*) is formed of a cylindrical base member 8*a* at which three radially projecting paddles 8*b* are arranged. The paddles 8*b* are composed of an elastic material with a rough surface such as, for example, rubber. In the present exemplary embodiment, the paddlewheel comprises three paddles 8*b* that are uniformly spaced from one another with an angular spacing of 120°.

The paddlewheel is secured to the paddle lever 9 with an L-shaped suspension 11. The L-shaped suspension 11 comprises a vertical, long leg 12 and a short horizontal leg 13. A drive shaft 14 on which the paddlewheel 8 is torsionally seated is seated at the lower end region of the long leg 12. The short leg 13 is arranged above the paddlewheel 8 and parallel to the drive shaft 14.

The suspension 11 is rotatably seated at an end region of the paddle lever 9, whereby a rotational axis extending vertically up from the paddle lever 9 is provided that engages through a hole introduced in the short leg 13.

A driven gear 18 composed of a pulley 16 and a conical gearwheel 17 is rotatably seated on the rotational axis somewhat above the horizontal leg 13. Together with three further conical gearwheels 19, the conical gearwheel 17 forms a mitre gear 20 for the transmission of the rotational movement of the driven gear 18 onto the paddlewheel 8. The further conical gearwheels 19 are arranged at the vertical leg 12, whereby the lowest of the conical gearwheels is seated on the drive shaft 14.

The mount 10 in the present exemplary embodiment is fashioned as a bearing receptacle in which a drive shaft 21 (see FIG. 1) extending through the bearing receptacle is rotatably seated. The drive shaft 21 comprises a polygonal crossection. A vertically arranged conical gearwheel 22 is torsionally seated on the drive shaft 21, the gearwheel 22 meshing with a drive wheel 23 composed of a conical gearwheel and a pulley.

The pulley of the gearwheel 23 and the pulley 16 of the driven gear 18 are wrapped by a belt 24, so that a rotational movement of the drive shaft 21 is transmitted onto the paddlewheel 8 via the drive wheel 23, the belt 24, the driven gear 18 and the mitre gear 20.

One end of an adjustment lever 25 is hinged to that end of the short leg 13 lying opposite the long leg 12, the other end of the adjustment lever 25 being secured to an adjustment means 26 provided at the mount 10. The adjustment means 26 of the present exemplary embodiment comprises a rotatory lever 28 that is rotatably seated around a vertical axis 29 and to whose one end the adjustment lever 25 is hinged, so that the adjustment lever 25 can be adjusted in its longitudinal direction as a result of a rotational movement of the rotatory lever 28. The movement of the adjustment lever is transmitted onto the suspension 11, which implements a corresponding rotational movement (see the double arrow 30) around the rotational axis 15. An exact setting of the rotatory lever can, for example, ensue by an actuation with a stepping motor.

An actuator that generates a linear motion can also be employed instead of an adjustment means that adjusts the adjustment lever with a rotational movement.

The adjustment means 26, the adjustment lever 25 and the short leg 13 form an adjustment mechanism with which the paddlewheel 8 can be turned around the axis 15 and, thus, with which the conveying direction 31 of the paddlewheels can be modified.

The rotational axis 15 around which the adjustment mechanism composed of the adjustment means and the adjustment lever 25 can be adjusted is preferably arranged on the angle bisector 32 for the two detents 3 and 4, and the range of adjustment amounts to +/−5° and, preferably, +/−10° with respect to the angle bisector 32. Given a range of adjustment of +/−10° with respect to the angle bisector 32, the angle between the conveying direction 31 and the detents 3 and 4 can be varied in the range from 35° through 55°. These angles also apply with respect to lines parallel to the angle bisector 32, i.e. the paddlewheels need not be arranged around the angle bisector but can also be arranged at some distance therefrom. As a result thereof, it is also possible that the paddlewheels do not point directly at the detents, whereby, however, imaginary extensions of the detents are targeted by their alignment.

During operation, sheets 2 are intermittently supplied in a conveying direction 33 at an admission side lying opposite the front detent 3. The sheets 2 are driven against the detents 3 and 4 by the paddles **8*b* of the paddlewheel, whereby the conveying direction 31 can be inventively set by turning the paddlewheel 8 around the rotational axis 15 such that the sheets 2 simultaneously reach the detents 3 and 4**.

As a result thereof, different types of sheets can be aligned with a device for aligning sheets, whereby the conveying direction 31 can be set dependent on the criterion of the paper type. Since the respective edges of the sheet simultaneously reach the two detents regardless of the basis weight, the roughness, stiffness and size of the sheet, the time needed for aligning a sheet is noticeably shortened, as a result whereof the delivered sheets can be neatly aligned at the detents and stacked even given high sheet rates of, for example, more than 80 through 160 sheets/min and, potentially, given even higher sheet rates such as, for example, 300 sheets/min.

Figure 3:
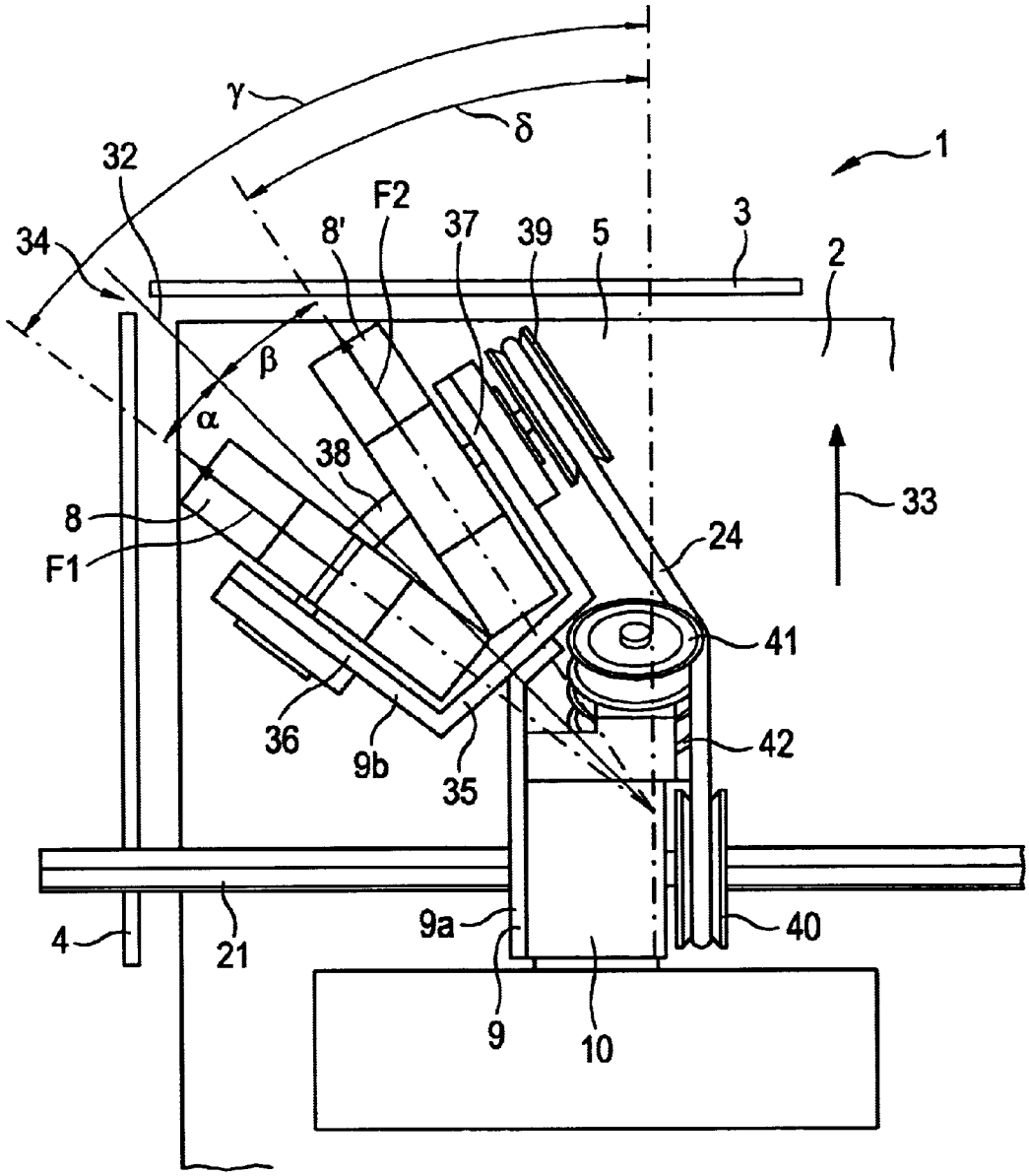
FIG. 3 shows a device for aligning sheets with two paddlewheels, in plan view.

FIG. 3 shows a second exemplary embodiment of the inventive device for aligning sheets.

This alignment device again comprises two detents 3 and 4 arranged at a right angle, a drive shaft 21 conducted through a mount 10, and a paddle lever 9 extending from the mount to two paddlewheels 8.

The paddle lever 9 is fashioned bipartite of a retainer rod **9*a* connected to the mount 10 and a fork element 9*b*, which is roughly U-shaped in the plan view, that is secured to the retainer rod 9*a* and has its open end arranged pointing to the corner region 34 limited between the detents 3 and 4. The fork element 9*b* comprises a base section 35 secured to the retainer rod 9*a* and two side sections 36 and 37 spread somewhat outward from the base section 35. A flexible shaft 38 that is bent away from the base section 35 is seated at these side sections 36 and 37. Two paddlewheels 8 and 8' are seated on the flexible shaft 38, whereby the two paddlewheels 8 and 8' are arranged neighboring one another inside the fork element 9*b* and approximately parallel to the side sections 36 and 37**.

Given the exemplary embodiment shown in FIG. 3, the conveying directions of the paddlewheels 8 and 8' describe an angle $\alpha$ or, respectively, $\beta$ of respectively 10° with the angle bisector for the detents 3 and 4, whereby the angles $\alpha$ and $\beta$ are open in the direction to the corner region 34 of the detents. The paddlewheel 8 thus has its conveying direction F1 pointing to the detent 4, and the paddlewheel 8' has its conveying direction F2 pointing to the detent 3. Accordingly, the conveying directions F1 and F2 of the paddle wheels 8 and 8' describe an angle $\delta$ of 35° and an angle $\gamma$ of 55° with the sheet delivery direction 33.

Figure 4A:
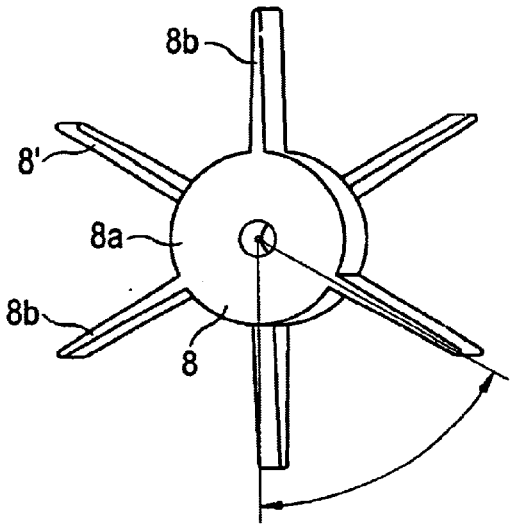
FIGS. 4*a*, 4*b* and 4*c* show the spatial arrangement of two paddlewheels of the device of FIG. 3, in a side view, in a perspective view and in a plan view.
Figure 4B:
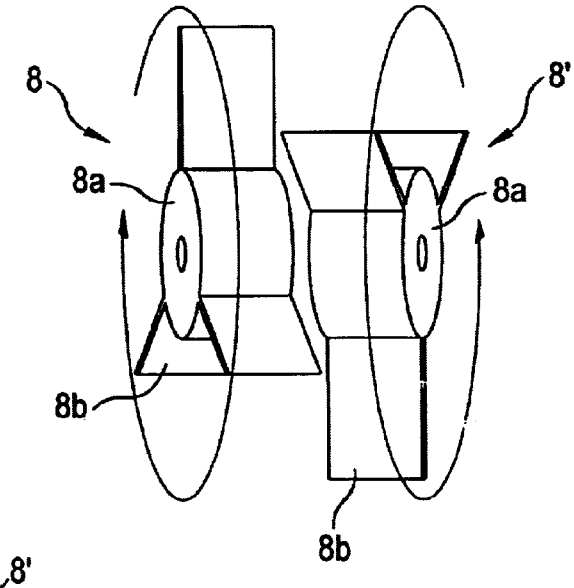
Figure 4C:
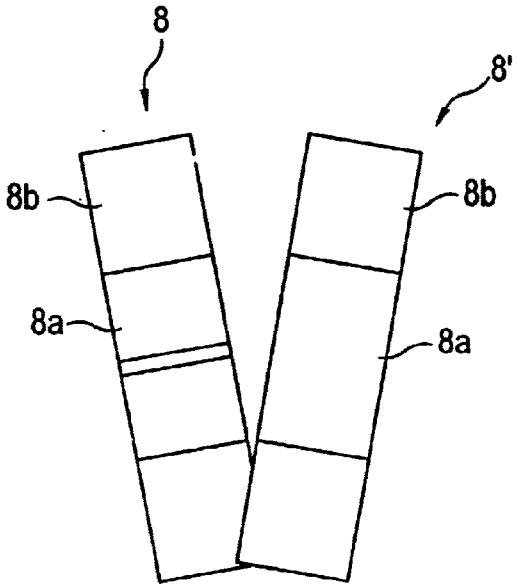

As a result of this arrangement of the paddlewheels 8 and 8', the delivered sheets 3 are "simultaneously" driven in the direction to the front detent by the paddlewheel 8' and in the direction to the lateral detent 4 by the paddlewheel 8. Since the paddlewheels 8 and 8' have their paddles **8*b* in contact with the sheet 2 in alternation, the sheet 2 is moved with short movements that are respectively directed in one of the two conveying directions F1 and F2 in alternation, since the two paddlewheels 8, 8' preferably have their paddles 8*b* arranged offset relative to one another, so that only a single respective paddlewheel touches a sheet 2 at one time (FIGS. 4*a*–4*c*). The overall motion can be represented by a vectorial addition of the partial motions. "Simultaneously" is to be understood in the sense of the average overall motion that is composed of the two motion components in the conveying directions F1 and F2**.

As a result of the arrangement of the paddlewheels in a V-shape in the plan view, the time needed for reaching the two detents 3 and 4 is considerably shortened compared to known alignment devices, since the incoming sheets 2 are simultaneously conveyed to the two detents 3 and 4.

The above arrangement can also be modified in the framework of the invention, whereby, for example, the conveying directions of the paddlewheels 8 and 8' are adapted dependent on the delivery speed, which is usually constant for a printer machine. For example, it can thus be expedient to set the angle $\alpha$ greater than the angle $\beta$. Given high delivery speeds, the angle between the sheet delivery direction 33 and the conveying direction of the paddlewheels 8 and 8', however, should not be greater than a predetermined angle of, for example, 50° through 60°.

Figure 5A:
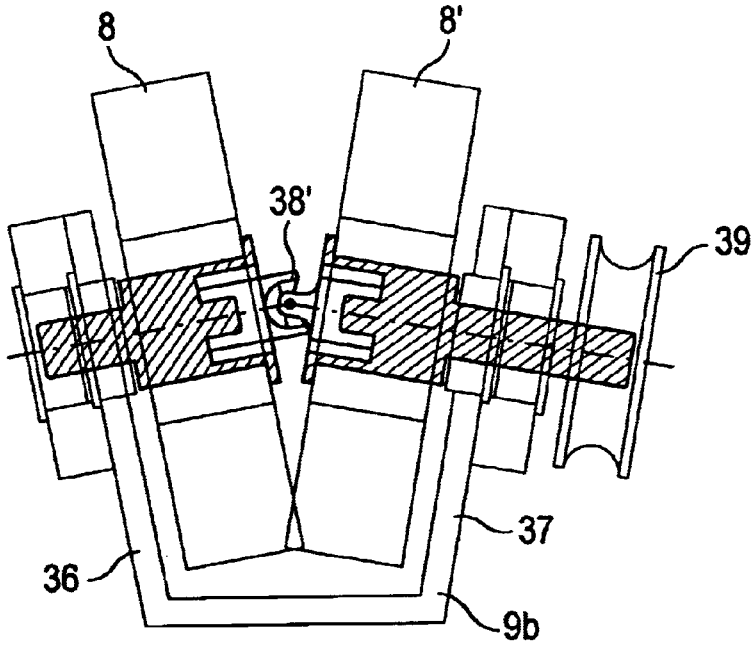
FIGS. 5*a* and 5*b* show two paddlewheels and their articulated connection in a plan view.

A shaft 38' provided with an articulation can also be employed instead of a flexible shaft 38. A fork element 9*b* is shown in FIG. 5*a* together with the paddlewheels 8 and 8' and the articulated shaft 38'. This embodiment differs from the above embodiment due to the different fashioning of the shaft and in that the two paddlewheels shear into one another (also see FIGS. 4*b* and 4*c*). Such a shearing arrangement of the paddlewheels 8 and 8' is very compact.

Figure 5B:
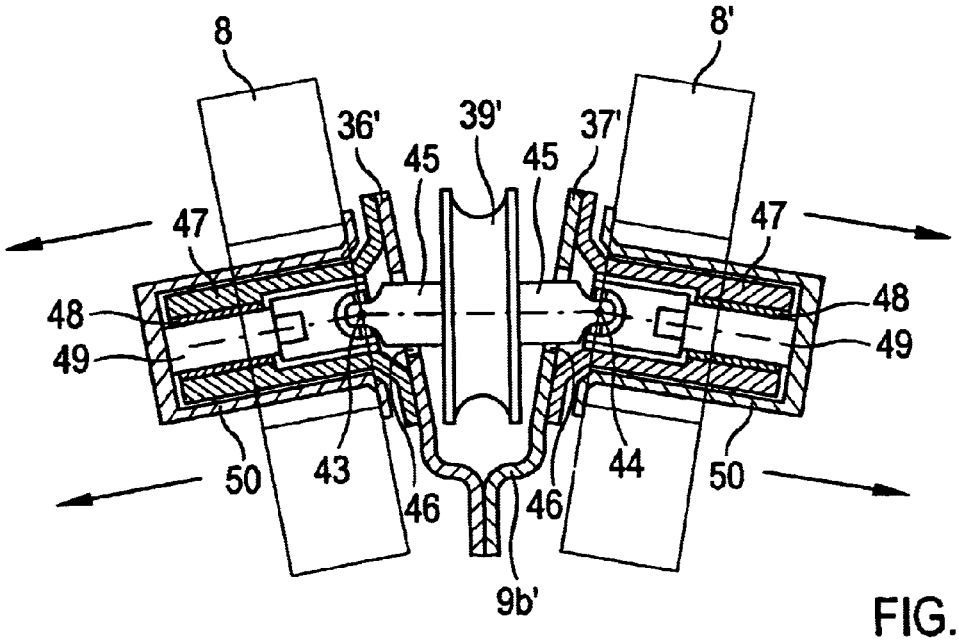

A further advantageous arrangement of the paddlewheels 8 and 8' with a fork element 9*b'* and a driven pulley 39' connected to the paddlewheels 8 and 8' via two universal joints 43 and 44 is shown in FIG. 5*b*. The fork element 9*b'* thereby employed is narrower in plan view than the fork elements employed in the above-described embodiments, whereby the driven pulley 39' is arranged between the side sections 36' and 37' thereof, the driven pulley 39' being provided with two lateral drive shaft stubs 45 that respectively engage with play through a hole in the side sections 36' and 37'. The drive shaft stubs 45 are respectively connected of one piece with the universal joints 43 and 44 arranged outside the fork element 9*b'*. The outwardly directed parts of the universal joints 46 are respectively arranged with play in a bearing bushing 47 secured to the side sections 36' and 37'. The bearing bushings 47 are respectively provided with a plain bearing 48 at their inside surfaces.

A pin-shaped inside bearing part 49 to which a bearing sleeve 50 surrounding the bearing bushing 47 is secured is respectively seated in the bearing bushings 47. The paddlewheels 8 and 8' are releasably seated on the bearing sleeves, so that they can be removed from the bearing sleeves 50 and plugged thereonto. This embodiment is very maintenance-friendly since the paddlewheels that are subject to a certain amount of wear are arranged at the outside at the fork element 9*b'* and can be easily removed and replugged.

Figure 6:
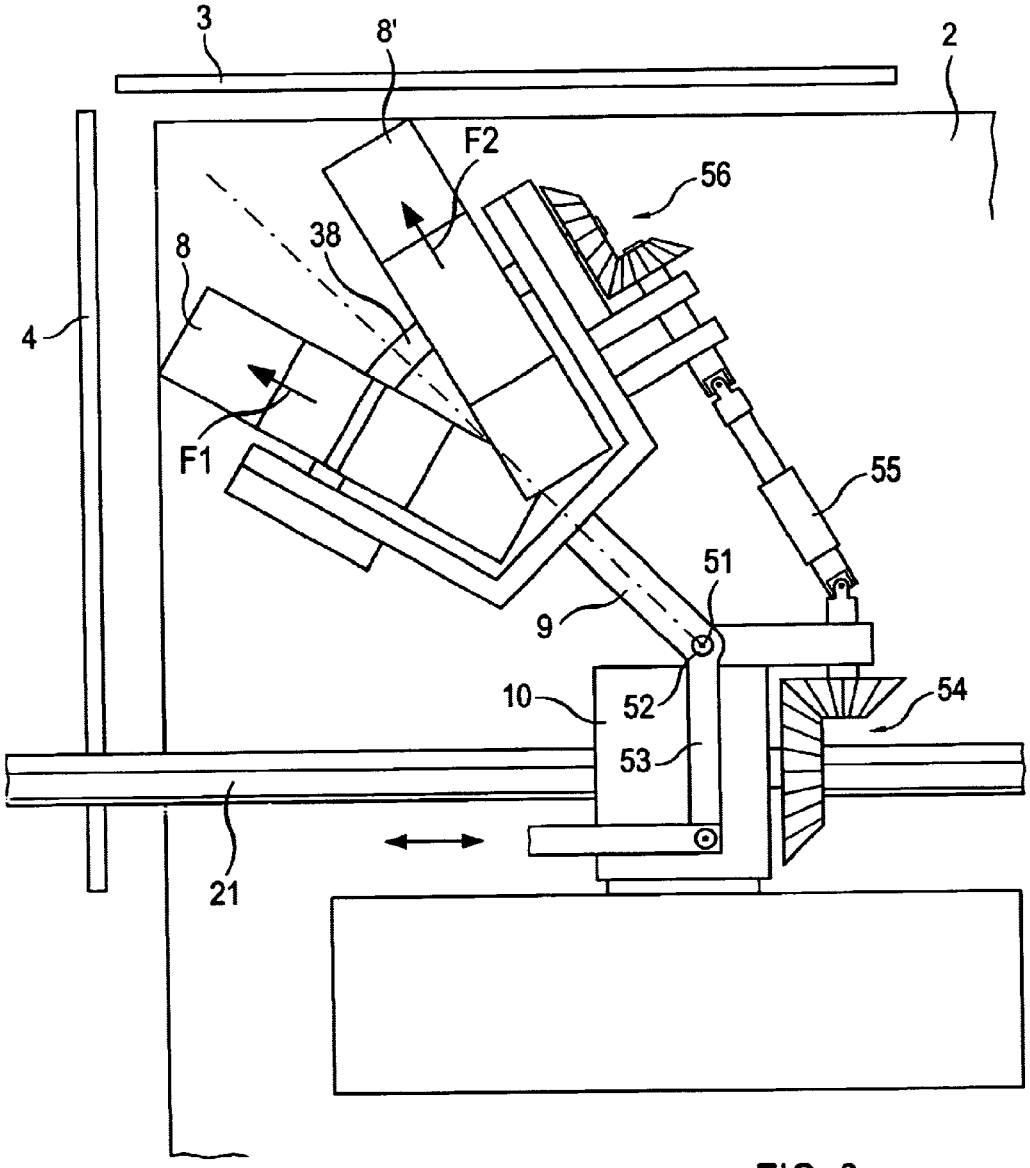
FIG. 6 shows a device for aligning sheets with two paddlewheels that can be swivelled around a common swivelling axis, in plan view.

FIG. 6 shows another modification of the exemplary embodiment shown in FIG. 3. The V-shaped arrangement (in plan view) of the paddlewheels 8 and 8' corresponds to that of FIG. 3, for which reason another more detailed description can be omitted. The alignment device shown in FIG. 6 differs from the exemplary embodiment described above in that the paddle lever is secured to the mount 10 with an articulation 51, so that the paddle lever 9 can be pivoted around an axis 52 perpendicular to the plane of the sheet acceptance region. The paddlewheel 9 is lengthened beyond the articulation 51 with a lever section 53 at which an adjustment mechanism (not shown) engages. The two paddlewheels 8 and 8' can be pivoted around the axis 52 with the adjustment mechanism, so that their conveying directions can be adapted to the paper type and the sheet delivery speed. A fine adaptation of the two conveying directions F1 and F2 can be achieved as a result thereof in order, for example, to align especially heavy paper neatly and at high speed.

The drive device comprises a mitre gearing 54 arranged at the mount 10 and connected to the drive shaft 21, a telescoping rod 55 that follows thereupon and is provided with a universal joint, and a mitre gearing 56 connected to the drive side of the telescoping rod 55 and the drive shaft 38 of the paddlewheels 8 and 8'. A rotational motion of the drive shaft is thus transmitted via the mitre gearing 54, the telescoping rod 55, and the mitre gearing 56 onto the drive shaft 38 of the paddlewheels 8 and 8'.

By employing the telescoping rod 55 provided with an articulation, this drive device can compensate the changes in length and angle occurring due to the pivot motion around the axis 52.

In another preferred embodiment, a damping mechanism is provided instead of an adjustment mechanism, this merely damping the reciprocating motion around the swivelling axis 52. The functioning of such an embodiment is explained below with reference to FIGS. 7*a* through 7*c*.

Due to the friction between the sheet and the respective paddlewheel, an opposing force $F_{opp}$ and $F_{opp}'$ acts on the two paddlewheels 8 and 8'.

Figure 7A:
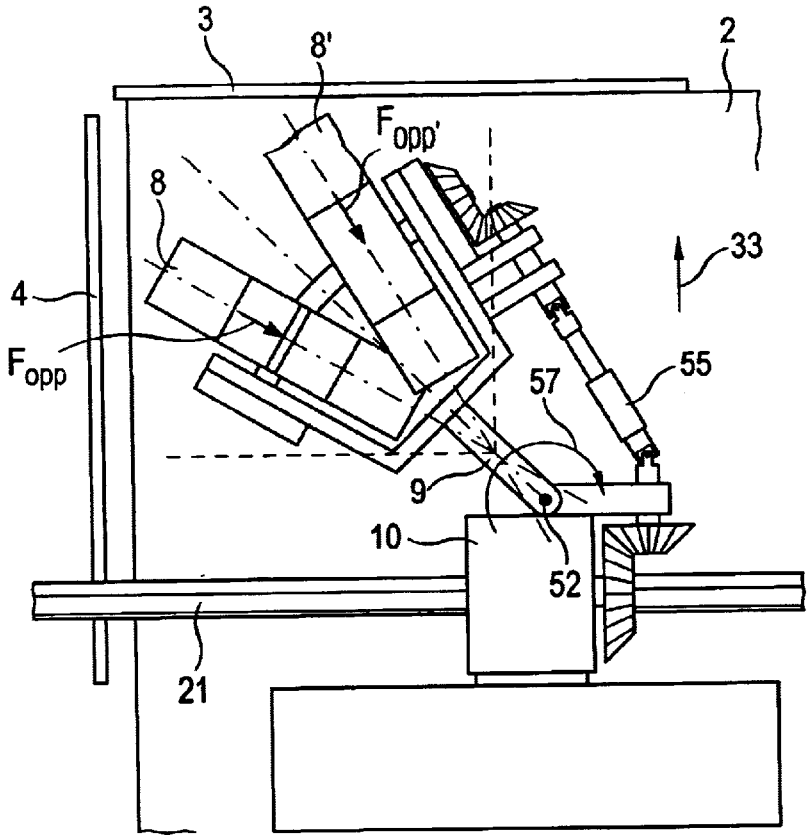
Figure 7B:
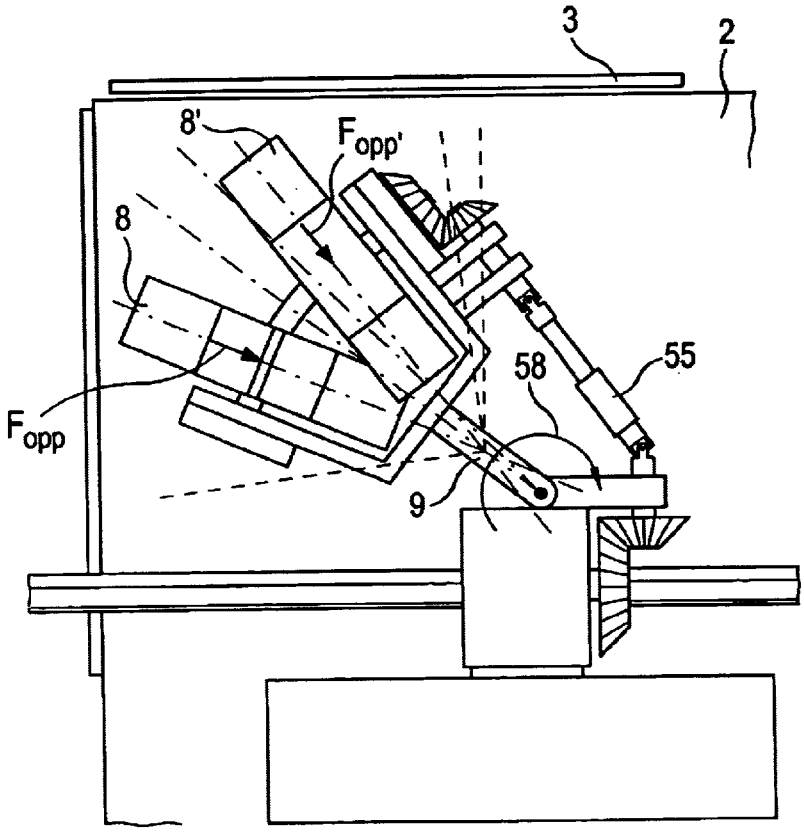
Figure 7C:
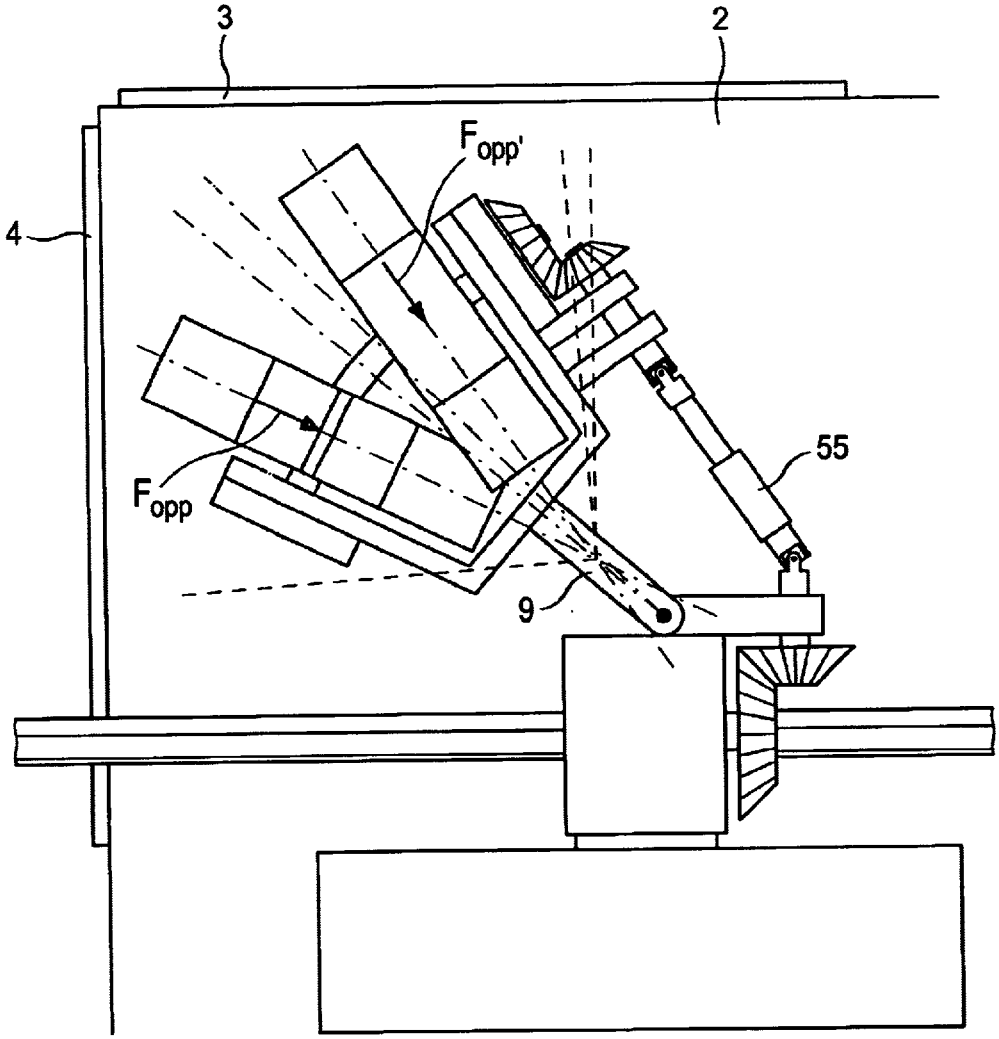

FIG. 7*a* shows the alignment device with a sheet 2 that is seated against the front detent 3. When the sheet 2 is seated against the detent 3, this can no longer yield in the sheet delivery direction 33, for which reason a greater opposing force $F_{opp}'$ acts on the paddlewheel 8' directed toward the detent 3 than on the paddlewheel 8 directed toward the lateral detent 4. A resultant force therefore derives that pivots the paddle lever 9 around the axis 52 in the direction to the detent 4 (arrow 57).

When, in contrast, a supplied sheet 2 comes into contact with the lateral detent 4 first, then the sheet 2 cannot yield farther toward the side and generates a higher opposing force directed away from the detent 4 onto the paddlewheel 8 than onto the paddlewheel 8'. As a result thereof, the paddle lever 9 together with the paddlewheels 8 and 8' is pivoted away from the detent 4 in the direction to the detent 3 (arrow 58).

After the alignment of a very few sheets 2, the paddle lever 9 is thus automatically adjusted to an angle at which the supplied sheets simultaneously reach the detents 3 and 4, so that the opposing forces $F_{opp}'$ and $F_{opp}$ acting on the two paddlewheels are of respectively the same size. A force equilibrium thus occurs that holds the paddlewheels 8 and 8' in the optimum position for the alignment of the sheets.

A damping device is preferably provided that damps the swivel motion of the lever 9, so that oscillations around the swivelling axis 52 are suppressed. Given a drive device with a telescoping rod 55, the telescope element integrated into the telescoping rod can assume this damping function.

This embodiment is distinguished by a structure that is mechanically very simple and effects a very effective optimization of the alignment event. This exemplary embodiment is described above on the basis of an embodiment with two paddlewheels. Such a freely pivotable paddle lever, however, can also be provided with only a single paddlewheel that likewise assumes an optimum angle determined by the described force equilibrium in order to simultaneously drive the sheets against the two detents.

Figure 8A:
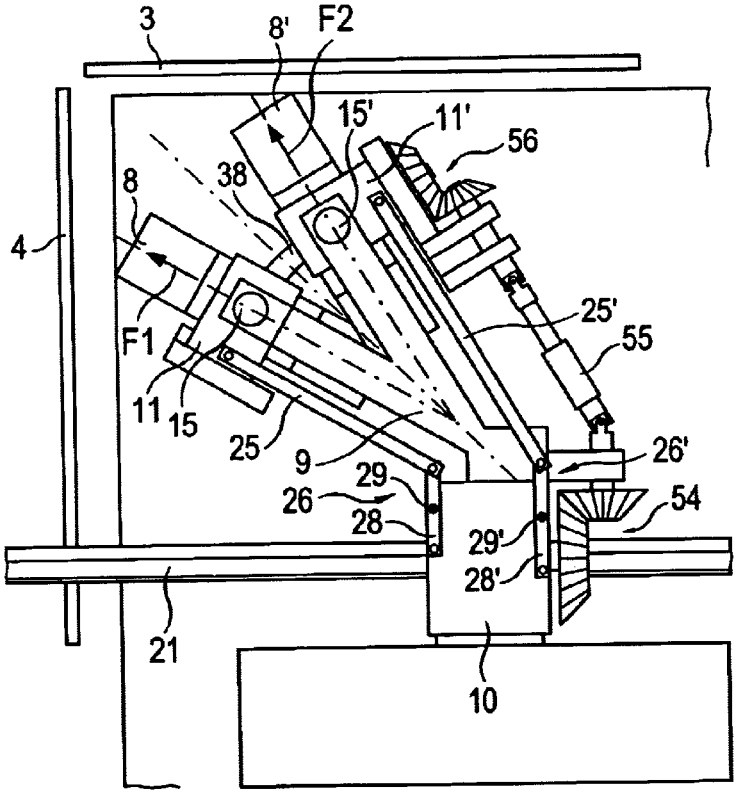
FIGS. 8*a* and 8*b* show a respective device for aligning sheets with two paddlewheels that are rotatable around a vertical rotational axis, in plan view.
Figure 8B:
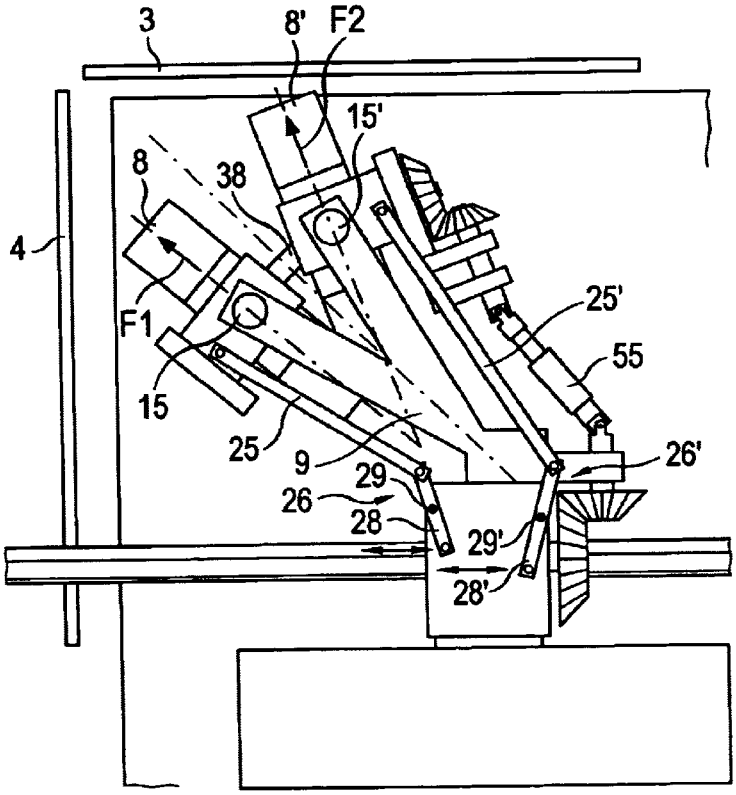

FIGS. 8*a* and 8*b* show a further exemplary embodiment of an inventive alignment device having two separately adjustable paddlewheels 8 and 8'. With respect to the arrangement of the paddlewheels 8 and 8' on a flexible drive shaft 38 and the fashioning of the drive device with a telescoping rod 55, it corresponds to the exemplary embodiment shown in FIG. 6, for which reason identical parts are provided with the same reference characters and another detailed description can be omitted.

Figure 2A:
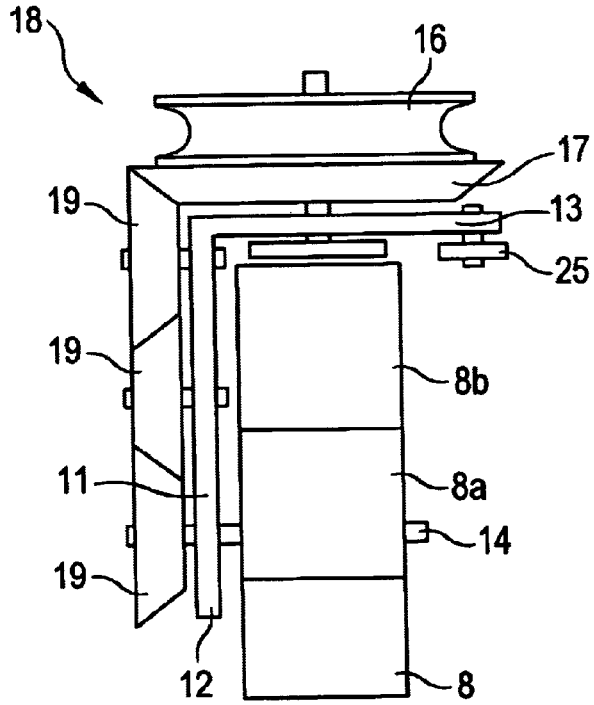
FIGS. 2*a* and 2*b* show the paddlewheel of FIG. 1 together with the suspension thereof, in a front view and, respectively, in a perspective view.
Figure 2B:
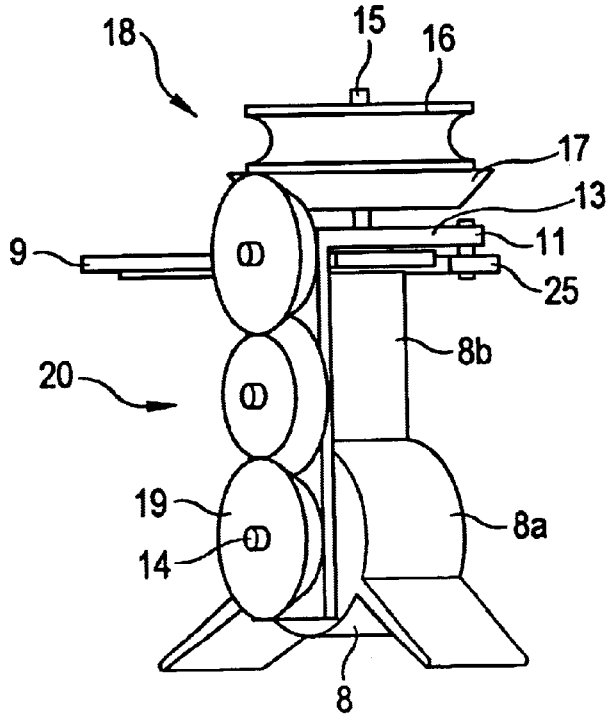

The two paddlewheels are respectively held by an L-shaped suspension 11 and 11', as shown in FIGS. 2*a* and 2*b*. The suspensions 11 and 11' are seated around a vertical axis 15 and 15' at the end regions of a paddle lever 9 that is V-shaped in plan view. The drive shaft 38 of the paddlewheels 8 and 8' is a flexible shaft that is seated at the suspensions 11 and 11' and on which the two paddlewheels are torsionally arranged.

An adjustment lever 25 and 25' has one end respectively hinged to the two suspensions 11 and 11', the other end thereof being connected to an adjustment mechanism 26 and 26'. The adjustment mechanisms 26 and 26' respectively each comprise a lever 28 and 28' that is pivotable around a respective axis 29 and 29'. The two adjustment mechanisms 26 and 26' can be actuated independently of one another, so that the conveying directions of the paddlewheels 8 and 8' can be adjusted independently of one another (FIG. 8*b*). This alignment device allows the delivery speeds to the two detents 3 and 4 to be set independently of one another.

The above-described exemplary embodiments respectively comprise single paddlewheels 8 and 8'.

Figure 9:
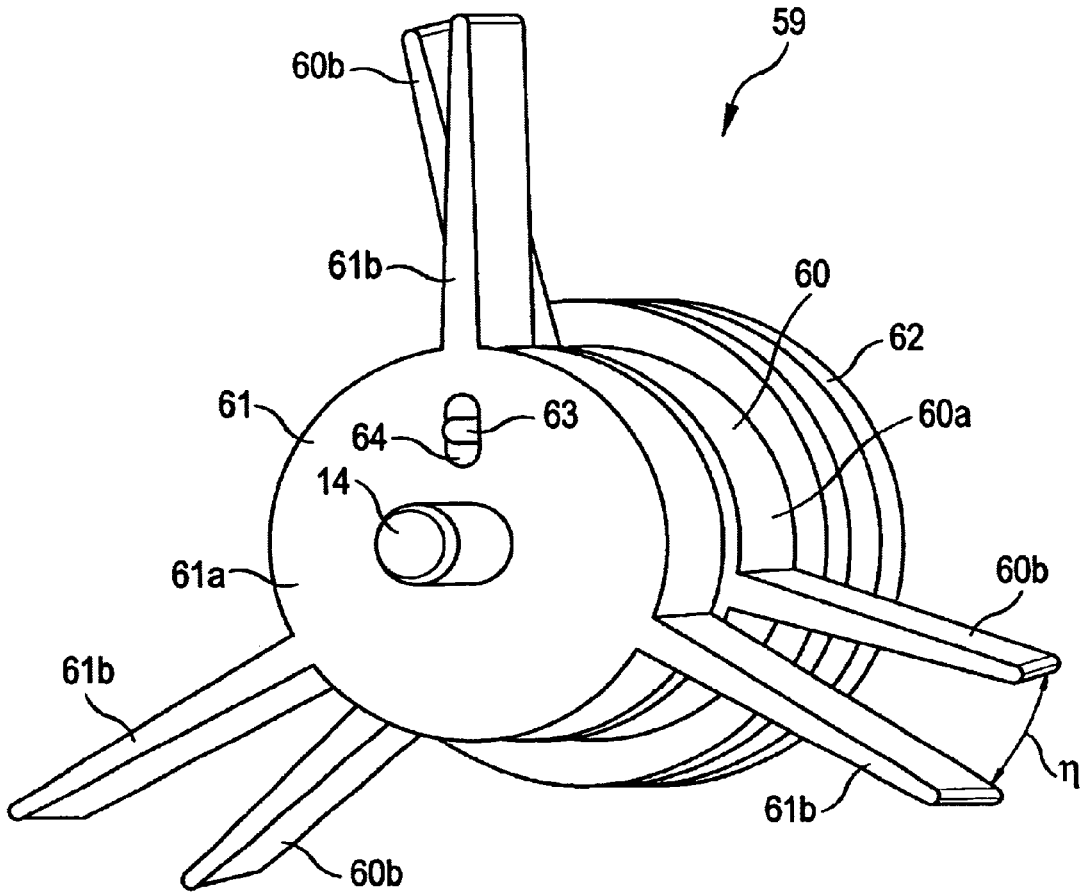
FIG. 9 shows a double paddlewheel in a perspective view.
Figure 10A:
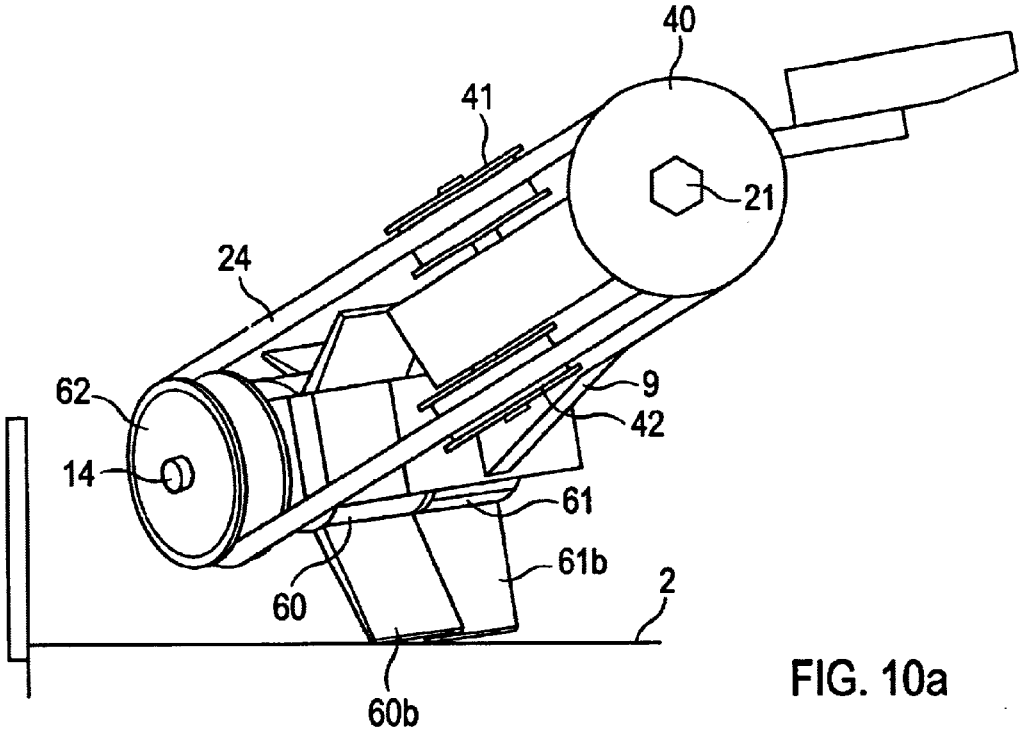
FIGS. 10*a*, 10*b*, 10*c* and 10*d* show a device for aligning sheets with a double paddlewheel, in perspective views.
Figure 10B:
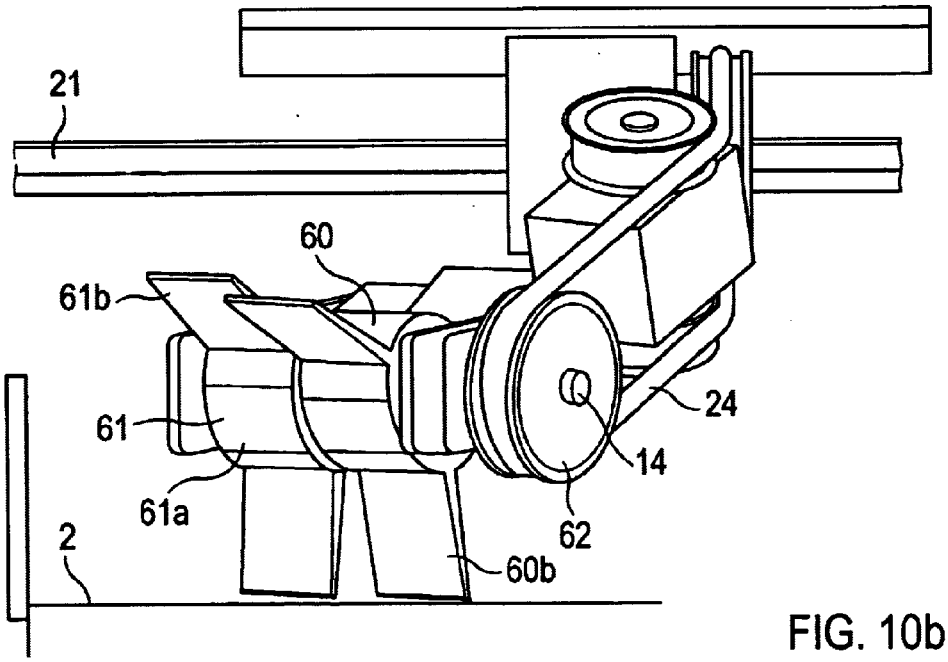

According to a preferred embodiment of the invention, these single paddle wheels 8 and 8' are replaced by double paddlewheels 59 (FIGS. 9, 10*a* and 10*b*).

Such a double paddlewheel 59 comprises two individual paddlewheels 60 and 61 that are seated on a shared, straight-line drive shaft 14. The individual paddlewheels 60 and 61 are arranged immediately next to one another and are again composed of a base member 60*a* and 61*a* and paddles 60*b* and 61*b* applied thereto.

Given the double paddlewheel shown in FIG. 9, the drive shaft 14 is secured to a pulley 62. Parallel to the drive shaft 14, a dog pin 63 is secured to the pulley 62. The dog pin 63 respectively engages through a hole 64 fashioned in the individual paddlewheels 60 and 61, so that a rotational motion of the pulley 62 is transmitted onto the individual paddlewheels 60 and 61.

The dog pin engages through the holes 64 into the base members 60*a* and 61*a* of the individual paddlewheels with some play in the rotational direction, so that the two individual paddlewheels 60 and 61 can turn by an angle $\eta$ of, for example, ±5° relative to one another around the drive shaft 14.

As a result thereof, an offset paddle arrangement as shown in FIGS. 9 through 10*b* can derive during operation given a drive shaft placed obliquely relative to the surface of the sheet stack.

Such an oblique setting of the drive shaft 14 occurs when the height of the top sheet 2 fluctuates when stacking sheets at high speed, whereby the entire height difference usually amounts to approximately 1 to 2 cm.

This height difference is compensated by a swivel motion of the paddle lever 9, whereby the paddle lever is thereby turned around its longitudinal axis, so that the drive shaft 14 of the paddlewheel is swivelled back and forth between a parallel and an inclined alignment relative to the surface of the sheet stack. Given paddlewheels with broad paddles, the paddles only touch the surface of the sheet stack with their entire paddle width when the drive shaft is arranged parallel to the surface of the sheet stack. When the drive shaft is inclined relative to the surface of the sheet stack, then, in contrast, they touch the top sheet of stack only with an edge region of the paddle.

It has been shown that, given an obliquely placed drive shaft 14, the paddles of the paddlewheel (paddlewheel 60 in FIGS. 10*a* and 10*b*) arranged at the lower region of the drive shaft 14 assume a position that is set back by the angle $\eta$ (FIG. 9) in the rotational direction compared to the other paddlewheel (paddlewheel 61 in FIGS. 10*a* and 10*b*). Given a change of the oblique position of the drive shaft relative to the surface of the sheet stack, the offset of the two paddlewheels 60 and 61 changes, so that the paddlewheel arranged at the lower region of the drive shaft 14 and, thus, closer to the surface of the sheet stack always assumes a trailing position with respect to the paddlewheel arranged at the upper region of the drive shaft 14 and, thus, at a greater distance from the surface of the sheet stack. When the drive shaft 14 is aligned parallel to the surface of the sheet stack, then the two paddlewheels arrange themselves without an offset, i.e. the angle $\eta$ is equal to 0.

Given an offset of the paddles 60*b* and 61*b* of the inventive double paddlewheel 59, both paddles 60*b* and 61*b* also touch the surface of the sheet stack (FIGS. 10*a* and 10*b*) given an inclined drive shaft 14. As a result thereof, the friction between the double paddlewheel 59 and the top sheet 2 of the stack remains constant regardless of the momentary stack height. This represents another critical improvement when stacking sheets at high speed that can also be utilized independently of the inventive alignment device.

Figure 10C:
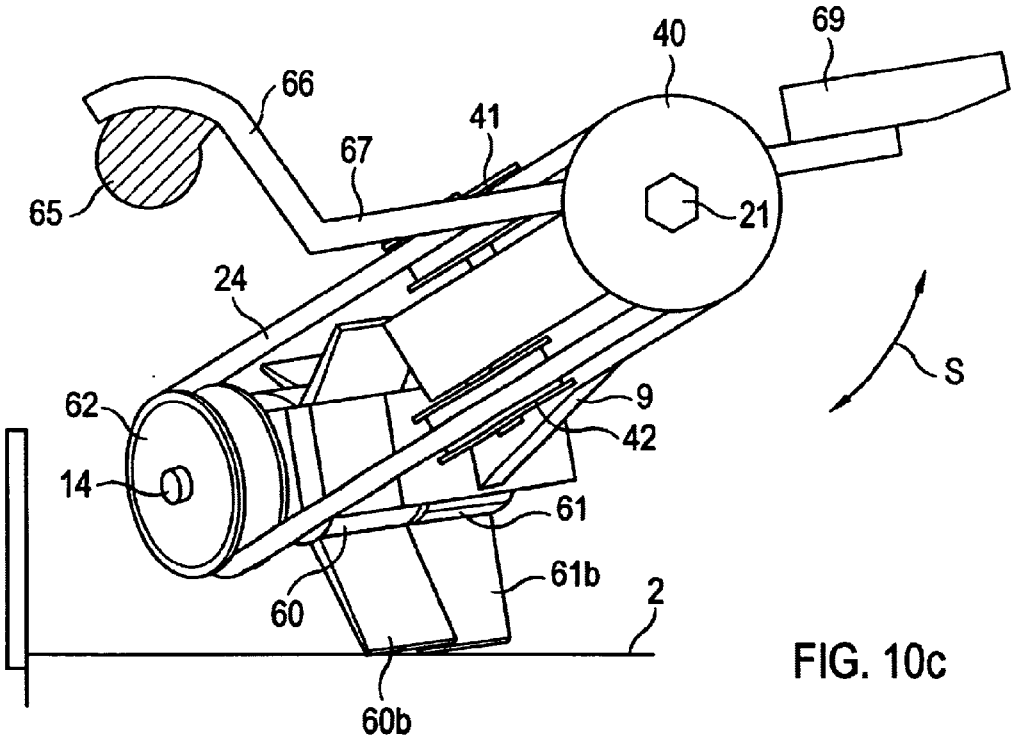
Figure 10D:
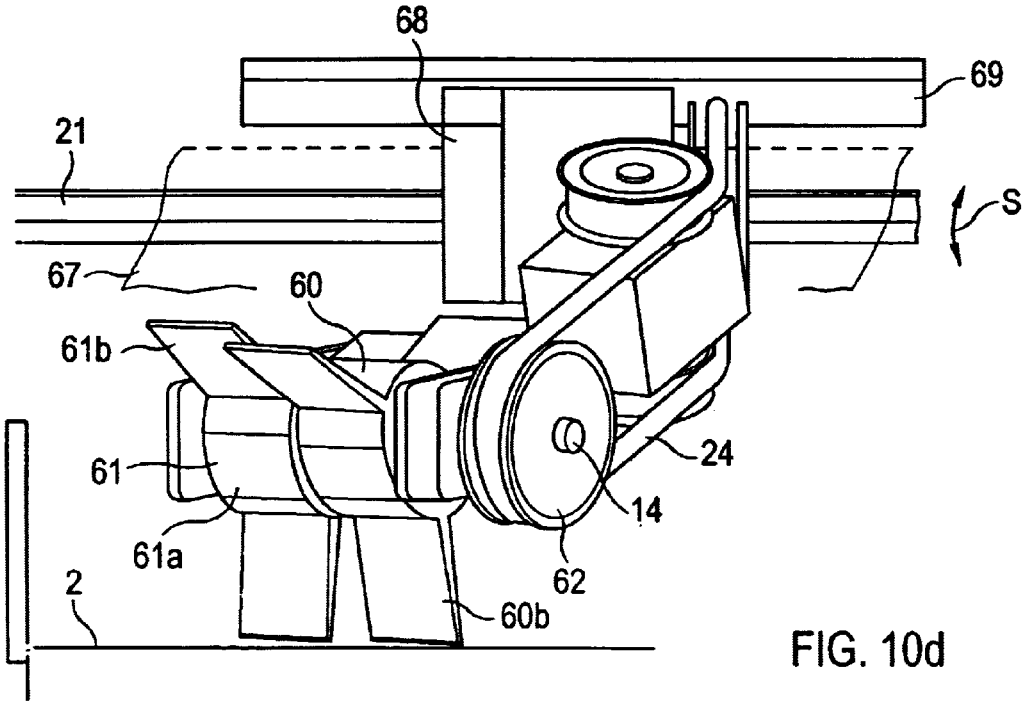

The apparatus of FIGS. 10*a* and 10*b* is shown again in FIGS. 10*c* and 10*d*, and the illustration is respectively supplemented by a few details. It becomes clear from these details as to how the alignment device can be switched between an operating mode wherein it aligns the sheets and a service mode wherein it can be serviced. To that end, the entire alignment device with the double paddlewheel 59 can be pivoted in an direction S around the drive shaft 21. Swivelling in and out ensue with an eccentric 65 fixed to the device and against which a shackle 66 is seated. The shackle 66 is rigidly connected to a plate 67. The plate 67 is movable seated relative to the drive shaft 21 on the basis of a bearing 68. The alignment device with the double paddle 59 can thus be lowered in the direction S relative to the frame-fixed plate 68. In the operating mode wherein the alignment device aligns single sheets, the device lies on the sheet stack 2 and is close to the plate 68. In order to be able to perform service work at the alignment device, for example in order to replace the paddlewheels 61, the sheet stack 2 lying on a lifting platform is first moved down with the lifting platform and away from the alignment device, and the alignment device is then swivelled away from the plate 68. The swivel motion is supported with a counterweight 69 that forms a counter-torque to the torque generated by the weight of the paddlewheels 60 and 61, respectively with the lever arm to the drive shaft 21.

The invention has been described above with reference to a number of exemplary embodiments. However, it is not limited to these exemplary embodiments. In the scope of the invention, for example, the detents can be formed, for example, of a plurality of pin-like elements, differing from that shown in the drawings where they are formed by a continuous wall or, respectively, ledge. Modifications in the various drive mechanisms and means for arranging the paddles over the sheet acceptance region are also possible. The number of paddles can be modified as needed, whereby, however, paddlewheels with three paddles have proven advantageous in practice. The universal joints utilized in the above-described exemplary embodiments can also be replaced by ball/pivot bearings or accordion bellows couplings.

The arrangement and/or adjustability of the conveying direction of the paddlewheels is critical for the invention. As a result thereof, the short time intervals between the alignment of two sheets that are required for stacking and aligning sheets supplied at a high rate can be achieved.

In summary, it can be reiterated:

The invention is directed to an device for aligning sheets in a single-sheet printer. The sheets are conveyed with a paddlewheel against two detents arranged at a right angle. In a first aspect of the invention, the paddlewheel is adjustable in a self-aligning fashion around an axis directed perpendicular to the sheet plane, so that the sheet is simultaneously driven against both detents. Two paddlewheels are provided in a second aspect of the invention, these describing and angle in the range from 30° through 60°, so that the sheets are automatically driven against both detents. In a third aspect of the invention, the paddlewheel is a double paddlewheel having two individual paddlewheels arranged side-by-side on the drive shaft. The two individual paddlewheels are thereby seated with play on the drive shaft, so that the paddlewheels can turn by and angle relative to one another on the drive shaft (14). As a result thereof, the conveying behavior is stabilized given paddles obliquely placed on the sheet stack, i.e. despite an oblique drive shaft. With the inventive device, sheets can be dependably stacked and aligned at a high rate, particularly at a rate of 80 sheets/minute and above, and with different basis weight, roughness and/or size.

Although other modifications and changes may be suggested by those skilled in the art, it is the intention of the inventors to embody within the patent warranted hereon all changes and modifications as reasonably and properly come within the scope of their contribution to the art.

LIST OF REFERENCE CHARACTERS

1 device for aligning sheets
2 sheets
3 detent
4 detent
5 sheet acceptance region
6 -- unassigned --
7 sheet positioning device
8 paddlewheel
8' paddlewheel
**8*b*** paddle
9 paddle lever
**9*a*** fork element
**9*b*** fork element
**9*b*'** fork element
10 mount
11 suspension
12 leg of the suspension 11
13 leg of the suspension 11
14 drive shaft
15 rotational axis
16 pulley
17 conical gearwheel
18 driven gear
19 conical gearwheel
20 mitre gearing
22 comical gearwheel
23 drive wheel
24 belt
25 adjustment lever
26 adjustment mechanism
27 --unassigned--
28 rotatory lever
29 vertical axis
30 double arrow
31 conveying direction
32 angle bisector
33 sheet delivery direction
34 corner region
35 base section
36 side section
36' side section
37 side section
37' side section
38 shaft
39 driven pulley
40 drive pulley
41 deflection roller
42 deflection roller
43 universal joint
44 universal joint
45 drive shaft stub
46 hole
47 bearing bush
48 plain bearing
49 inside bearing part
50 bearing sleeve
51 articulation
52 axis
53 lever section
54 mitre gearing
55 telescoping rod
56 mitre gearing
57 arrow
58 arrow
59 double paddlewheel
60 single paddlewheel
**60*a*** base member of the single paddlewheel
**60*b*** paddles of the single paddlewheel
61 single paddlewheel
**61*a*** base member of the single paddlewheel
**61*b*** paddles of the single paddlewheel
62 pulley
63 dog pin
64 hole
65 eccentric
66 shackle
67 plate
68 plate bearing
69 counterweight
S swivel direction

What is claimed is:

1. A device for aligning sheets, comprising:

a sheet acceptance region that is limited by two detents arranged at a right angle relative to one another; and a sheet positioning mechanism that is arranged within said sheet acceptance region lying opposite a corner limited by said two detents, said sheet positioning mechanism including:

a drive shaft, a double paddlewheel that is rotationally driven around a drive axis that is approximately parallel to a plane of said sheet acceptance region so that a sheet supplied to said sheet acceptance region is brought into a seated condition against both of said two detents, said double paddlewheel having two individual paddlewheels arranged side-by-side on said drive shaft, each of said two individual paddlewheels including a base member with paddles extending from said base member, and said two individual paddlewheels being seated on said drive shaft with play in a rotational direction so that the paddlewheels can rotate on said drive shaft by an angle relative to one another, wherein said angle through which said two paddlewheels can rotate on said drive shaft relative to one another lies in the range from ±2° through ±10°.

2. A device as claimed in claim 1, wherein said sheet positioning mechanism is adjustable around an axis residing perpendicular to a plane of the sheet acceptance region so that a conveying direction of the paddlewheels is variable.

3. A device as claimed in claim 2, wherein the axis for adjustment of said sheet positioning mechanism is a rotational axis proceeding through a center of the at least one paddlewheel, and further comprising:

an L-shaped suspension having a vertical leg and a horizontal leg, said drive shaft being seated at an end region of said vertical leg, said horizontal leg being above said at least one paddlewheel parallel to said drive shaft.

4. A device as claimed in claim 3, further comprising:

a paddle lever having an end region;

the horizontal leg of the L-shaped suspension being seated at the end region of said paddle lever, said horizontal leg being seated rotatable around a rotational axis; and a mount to which said paddle lever has its other end region secured.

5. A device as claimed in claim 4, further comprising:

a driven gear rotatably seated around the rotational axis and provided at the horizontal leg; and a mitre gear mounted to transmit rotatory motion of said driven gear to the at least one paddlewheel.

6. A device as claimed in claim 5, further comprising:

a belt engaging the driven gear, said driven gear being arranged at a suspension; and a drive wheel arranged at the mount and in engagement with the belt.

7. A device as claimed in claim 3, further comprising:

an adjustment mechanism for adjustment of a conveying direction of said at least one paddlewheel, said adjustment mechanism including an adjustment lever that is secured in articulated fashion to an end region of said horizontal leg of said suspension and that is secured to said mount with an adjustment device.

8. A device as claimed in claim 7, wherein the adjustment device is a rotatory lever driven by a stepping motor.

9. A device as claimed in claim 1, wherein an axis for adjustment of said sheet positioning mechanism is a swivelling axis offset from a center of said at least one paddlewheel in a direction to an admission side of said sheet acceptance region, said sheet positioning mechanism being freely swivelable around the swivelling axis.

10. A device as claimed in claim 9, further comprising:

a damping mechanism for damping swivel motion of said at least one paddlewheel.

11. A device as claimed in claim 9, wherein said sheet positioning mechanism is arranged at an end region of a paddle lever and the other end region of the paddle lever is secured to a mount, and further comprising:

a drag link at said end region of the paddle lever arranged at the mount so that at least one part of the paddle lever is fashioned pivotable around the swivelling axis.

12. A device for aligning sheets, comprising:

a sheet acceptance region that is limited by two detents arranged at a right angle relative to one another; and a sheet positioning mechanism that is arranged within said sheet acceptance region lying opposite a corner limited by said two detents, said sheet positioning mechanism including:

a drive shaft, a double paddlewheel that is rotationally driven around a drive axis that is approximately parallel to a plane of said sheet acceptance region so that a sheet supplied to said sheet acceptance region is brought into a seated condition against both of said two detents, said double paddlewheel having two individual paddlewheels arranged side-by-side on said drive shaft, each of said two individual paddlewheels including a base member with paddles extending from said base member, and said two individual paddlewheels being seated on said drive shaft with play in a rotational direction so that the paddlewheels can rotate on said drive shaft by an angle relative to one another;

a pin extending in an opening in said base member of each of said two individual paddlewheels with play in a rotational direction.

13. A device as claimed in claim 12, wherein said two paddlewheels are arranged on a common drive shaft so that they are driven synchronized with one another.

14. A device as claimed in claim 12, wherein said drive shaft is articulated.

15. A device as claimed in claim 14, wherein said drive shaft includes a universal joint.

16. A device as claimed in claim 14, wherein said drive shaft includes an accordion bellows coupling.

17. A device as claimed in claim 12, wherein said drive shaft is flexible.

18. A device as claimed in claim 12, wherein said two paddlewheels each include a cylindrical base member having a plurality of radially salient paddles that are arranged at a circumference of said cylindrical base member with substantially identical spacing from one another, said radially salient paddles of a first of said two paddlewheels being offset from said radially salient paddles of a second of said two paddlewheels in a rotational direction of said paddlewheels.

19. A device as claimed in claim 18, wherein said two paddlewheels each include three paddles, and said paddles of one of said two paddlewheels are offset by approximately 60° relative to said paddles of another of said two paddlewheels.

20. A device as claimed in claim 18, wherein said two paddlewheels are arranged in such close proximity to one another that said paddles of said two paddlewheels shear into one another.

21. A device as claimed in claim 12, further comprising:

a driven gear arranged between said two paddlewheels, said driven gear including a drive shaft stub projecting at both lateral surfaces that are respectively connected in articulated and torsional fashion to a bearing sleeve for acceptance of respectively one of said two paddlewheels.

22. A device as claimed in claim 12, further comprising:

a paddle lever having an end region at which said two paddlewheels are arranged, said paddle lever having another end region of the paddle lever secured to a mount.

23. A device for aligning paper sheets, comprising:

a sheet acceptance region that is limited by two detents arranged at a right angle relative to one another;

a sheet positioning mechanism that is arranged within said sheet acceptance region lying opposite a corner limited by said two detents, said sheet positioning mechanism including:

a drive shaft, a double paddlewheel that is rotationally driven around a drive axis that is approximately parallel to a plane of said sheet acceptance region so that a sheet supplied to said sheet acceptance region is brought into a seated condition with both of said two detents, said double paddlewheel having two individual paddlewheels arranged side-by-side on said drive shaft, and said two individual paddlewheels each including a base member with paddles applied thereto, and said two individual paddlewheels being seated on said drive shaft with play in a rotational direction so that the paddlewheels can rotate on said drive shaft by an angle relative to one another; and a telescoping rod for driving said two paddlewheels, said telescoping rod being at least one of flexible and articulated to compensate for at least one of rotational and swivel motions.

24. A device as claimed in claim 23, wherein said two paddlewheels are adjustable independently of one another around a rotational axis perpendicular to the plane of said sheet acceptance region.

25. A device as claimed in claim 23, further comprising:

a paddle lever;

a separate suspension for said two paddlewheels that is respectively rotatably hinged to said paddle lever; and adjustment mechanisms for adjustment of conveying direction of said two paddlewheels, said adjustment mechanisms each include an adjustment lever extending approximately parallel to said paddle lever, said adjustment levers being respectively secured articulated to said separate suspension, and an adjustment device exerting a rotational motion onto the respective suspension and the corresponding paddlewheel.

26. A device as claimed in claim 23, further comprising:

a paddle lever having an end region at which said two paddlewheels are mounted;

said two paddlewheels having conveying directions which describe a constant angle;

a swivel axis for adjustment of said sheet positioning mechanism being offset from said drive shaft in a direction toward an admission side of said sheet acceptance region, said sheet positioning mechanism being freely pivotable around said swivel axis.

27. A device as claimed in claim 26, wherein an angle between the conveying directions of said two paddlewheels lies in a range from 10° through 20°.

28. A device as claimed in claim 23, further comprising:

a paddle lever holding said two paddlewheels and being mounted at a mount; and a miter gear connected to the drive shaft of the two paddlewheels;

said telescoping rod extending approximately parallel to said paddle lever from said mount to which said paddle lever is attached up to said miter gear.

29. A device for aligning sheets, comprising:

a sheet acceptance region that is limited by two detents arranged at a right angle relative to one another;

a sheet positioning mechanism within said sheet acceptance region lying opposite a corner limited by said two detents, said sheet positioning mechanism including at least one paddlewheel that is rotationally driven on a drive axis that is approximately parallel to a plane of said sheet acceptance region so that a sheet supplied to said sheet acceptance region is brought into a seated condition with both of said two detents, said sheet positioning device being adjustable around an axis perpendicular to the plane of said sheet acceptance region so that a conveying direction of said at least one paddlewheel is variable; and a telescoping rod for driving said two paddlewheels, said telescoping rod being at least one of flexible and articulated to compensate for at least one of rotational and swivel motions.

30. A device for aligning sheets, comprising:

a sheet acceptance region that is limited by two detents arranged at a right angle relative to one another;

a sheet positioning mechanism within said sheet acceptance region lying opposite a corner limited by said two detents, said sheet positioning mechanism including:

a drive shaft, a double paddlewheel that is rotationally driven around a drive axis that is approximately parallel to a plane of said sheet acceptance region so that a sheet supplied to said sheet acceptance region is brought into a seated condition with both of said two detents, said double paddlewheel having two individual paddlewheels arranged side-by-side on the drive shaft, each of said individual paddlewheels including a base member with paddles applied thereto, and said two individual paddlewheels being seated on said drive shaft with play in a rotational direction so that a first of said two paddlewheels rotate on said drive shaft by an angle relative to a second of said two paddlewheels, said angle through which said two paddlewheels can rotate on said drive shaft relative to one another lies in the range from ±2° through ±10°.

31. A device for aligning sheets in a printer or copier, comprising:

a sheet acceptance region that is limited by two detents arranged at a right angle relative to one another; and a sheet positioning mechanism that is arranged within said sheet acceptance region lying opposite a corner limited by said two detents, said sheet positioning mechanism includes:

a drive shaft, a double paddlewheel that is rotationally driven on a drive axis that is approximately parallel to a plane of said sheet acceptance region so that a sheet supplied to said sheet acceptance region is brought into a seated condition against both of said two detents, said double paddlewheel having two individual paddlewheels arranged side-by-side on said drive shaft, and said two individual paddlewheels each including a base member with paddles applied thereto, and said two individual paddlewheels being seated on said drive shaft with play so that the paddlewheels can rotate on said drive shaft by an angle relative to one another, and a pin extending in an opening in said base member of each of said two individual paddlewheels with play in a rotational direction.

* * * * *